US010816012B2

(12) United States Patent
Kim et al.

(10) Patent No.: US 10,816,012 B2
(45) Date of Patent: Oct. 27, 2020

(54) MOUNTING ASSEMBLY OF ELECTRIC PUMP

(71) Applicants: Hyundai Motor Company, Seoul (KR); KIA Motors Corporation, Seoul (KR)

(72) Inventors: Hark-Koo Kim, Seoul (KR); Seung-Yong Lee, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/377,852

(22) Filed: Apr. 8, 2019

(65) Prior Publication Data

US 2020/0049164 A1 Feb. 13, 2020

(30) Foreign Application Priority Data

Aug. 7, 2018 (KR) ..... 10-2018-0091838

(51) Int. Cl.
*F04D 29/62* (2006.01)
*F04D 13/06* (2006.01)

(52) U.S. Cl.
CPC ..... *F04D 29/628* (2013.01); *F04D 13/06* (2013.01)

(58) Field of Classification Search
CPC ..... F04D 29/628; F04D 13/06
USPC ..... 248/580, 608, 609, 610, 612, 634, 635, 248/638, 674, 74.1, 74.2, 65, 548
See application file for complete search history.

(56) References Cited

U.S. PATENT DOCUMENTS 5,398,907 A * 3/1995 Kelchner ..... F01N 13/1822 248/60
7,546,986 B2 * 6/2009 Kim ..... F16L 3/1008 248/62
7,770,848 B2 * 8/2010 Johnson ..... F16L 3/1207 248/65
8,075,235 B2 * 12/2011 Kosiankowski ..... F16B 2/14 411/267
8,590,847 B2 * 11/2013 Guthke ..... H02G 3/32 248/68.1
2001/0052564 A1 * 12/2001 Karlinger ..... B25J 19/0025 248/74.1
2003/0094547 A1 * 5/2003 Wilkinson, III ..... F16L 3/1008 248/74.1
2004/0217236 A1 * 11/2004 Shibuya ..... F16L 3/13 248/68.1

(Continued)

FOREIGN PATENT DOCUMENTS

JP H09126198 A 5/1997
JP 2008240543 A 10/2008

(Continued)

*Primary Examiner* — Terrell L McKinnon
*Assistant Examiner* — Michael McDuffie
(74) *Attorney, Agent, or Firm* — Brinks Gilson & Lione

(57) ABSTRACT

A mounting assembly of an electric pump may include a mounting body configured to mount the electric pump, and a bracket including a structure configured for enclosing and fixing the mounting body. Furthermore, force dampening elements of the electric pump hit a seating portion of the mounting body along a fracture line of the mounting body to break the seating portion and move the electric pump toward a front of the vehicle. Accordingly, the safety for driving a vehicle is improved and the injury of a driver is reduced during a collision of the vehicle.

19 Claims, 8 Drawing Sheets

(56) References Cited

U.S. PATENT DOCUMENTS

2006/0284028 A1* 12/2006 Tenma ..... F16L 3/105 248/65
2007/0158506 A1* 7/2007 Trotter ..... F16B 5/0685 248/65
2009/0218452 A1* 9/2009 Kosiankowski ..... F16B 2/14 248/74.1
2011/0248126 A1* 10/2011 Mark ..... F16L 59/025 248/74.1
2011/0297797 A1* 12/2011 Yelverton ..... B60T 11/046 248/70
2012/0181411 A1* 7/2012 Rodecker ..... F01N 13/1805 248/634
2012/0279064 A1* 11/2012 Reinhardt ..... F01D 25/285 29/888
2012/0292460 A1* 11/2012 Hsu ..... H02G 3/32 248/70
2014/0027604 A1* 1/2014 Gong ..... H05K 7/20172 248/672
2014/0151528 A1* 6/2014 Park ..... F16F 3/093 248/634
2014/0197299 A1* 7/2014 Oppenheimer ..... F16F 15/04 248/638
2014/0263867 A1* 9/2014 Brown ..... F16L 3/08 248/65
2014/0367547 A1* 12/2014 Ohnishi ..... F16F 1/36 248/638
2015/0219247 A1* 8/2015 Kim ..... F16L 3/13 248/74.2
2016/0006230 A1* 1/2016 Parsons ..... F16L 3/1222 248/548
2016/0201756 A1* 7/2016 Sakamoto ..... F16F 1/3849 248/634
2016/0258340 A1 9/2016 Klippert et al.
2016/0377144 A1* 12/2016 McLean ..... D06F 37/24 248/634

FOREIGN PATENT DOCUMENTS

KR 20110058589 A 6/2011
KR 101250969 B2 4/2013
KR 20130049580 A 5/2013

* cited by examiner

MOUNTING ASSEMBLY OF ELECTRIC PUMP

CROSS-REFERENCE TO RELATED APPLICATIONS

This application claims priority to and the benefit of Korean Patent Application No. 10-2018-0091838, filed on Aug. 7, 2018, which is incorporated herein by reference in its entirety.

FIELD

The present disclosure relates to a mounting assembly of an electric pump for a vehicle.

BACKGROUND

The statements in this section merely provide background information related to the present disclosure and may not constitute prior art.

Generally, a maximum temperature of combustion gas burned in an engine of a vehicle reaches 2000° C. or higher. However, all of the combustion heat is not converted into power, and a considerable amount of the combustion heat is absorbed by a cylinder head, a piston, and the like to cause a heat loss and overheating of these components.

Accordingly, if the temperature of the cylinder or the like rises excessively, the cylinder is deformed or an oil film is destroyed. It results in defective lubrication. In severe cases, the engine is damaged and the combustion state is also poor to cause knocking or early ignition, thereby suddenly reducing the power of the engine.

Therefore, in most vehicles, cooling is desired to protect the engine and components around a combustion chamber constituting the engine, and a cooling system is mounted on vehicles. In addition, a water jacket for passing cooling water is formed on the cylinder block and the cylinder head constituting the engine, and a water pump for pumping cooling water into the water jacket is mounted on one side of the front of the engine.

However, we have discovered that such a cooling system threatens the safety of the driver during the collision of the vehicle. At the time of the vehicle collision, a collision of the water pump or an electronic brake booster causes a brake pedal to move toward the driver and injure the driver.

The above information disclosed in this Background section is only for enhancement of understanding of the background of the present disclosure, and therefore it may contain information that does not form the prior art that is already known to a person of ordinary skill in the art.

SUMMARY

The present disclosure provides a mounting assembly of an electric pump capable of improving safety by inhibiting devices mounted on a vehicle from intruding into an interior space of the vehicle at the time of a collision of the vehicle.

In accordance with a form of the present disclosure, a mounting assembly of an electric pump includes a mounting body configured to mount the electric pump, and a bracket including a structure configured for enclosing and fixing the mounting body. force dampening elements of the electric pump hit a seating portion of the mounting body along a fracture line of the mounting body to break the seating portion and move the electric pump toward a front of the vehicle.

In accordance with a further aspect of the present disclosure, a material of the mounting body may be rubber. The mounting body may include a seating portion on which the electric pump is seated, and a fixing portion extended downward from the seating portion for fixing to a bottom surface.

The seating portion may be formed in an annular shape. The seating portion may further include inner pressing surfaces, at least one inner hole formed between the pressing surfaces, at least one outer hole positioned at an outer periphery of the inner hole, and a high frequency damping slot positioned at the same outer periphery as the outer hole.

In accordance with a further aspect of the present disclosure, the inner hole may be formed in a semi-circular shape, the outer hole may be formed in a circular shape, and the high frequency damping slot may be formed in an arch shape. The outer hole and the high frequency damping slot may be alternately formed along the outer periphery of the inner hole. Furthermore, the outer hole and the high frequency damping slot may form the fracture line on the seating portion of the mounting body.

In accordance with a further aspect of the present disclosure, the seating portion may be formed with a mounting open slot. An inside of the seating portion may be provided with a stopper. An outside of the seating portion may be provided with an opening notch. The fixing portion may is formed in a symmetrical shape with respect to a center line of the mounting body along a Z-axis.

In accordance with a further aspect of the present disclosure, the fixing portion may be provided with a load damper. The loading damper may be formed in an indented shape, and an outer edge of the mounting body may be provided with a bracket guide for guiding the bracket.

The bracket may is formed in a U-letter shape, and a lower part of the bracket may be provided with a fracture notch to be fractured at the time of a collision.

An outer peripheral part of the electric pump may be provided with the force dampening elements to form the fracture line on the seating portion of the mounting body. The force dampening elements may include a fracture blade and a housing connector.

In accordance with another form of the present disclosure, a mounting assembly of an electric pump includes a mounting body having the electric pump mounted thereon at the time of an offset collision and allowing force dampening elements of the electric pump to hit a seating portion of the mounting body along a fracture line of the mounting body to break the seating portion and move the electric pump toward a front of the vehicle, and a bracket having a structure configured for enclosing and fixing the mounting body.

According to one form of the present disclosure, the mounting assembly of the electric pump can inhibit the devices mounted on the vehicle from intruding into the interior space of the vehicle at the time of the collision of the vehicle to reduce the injury of the drivers, thereby improving the safety.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
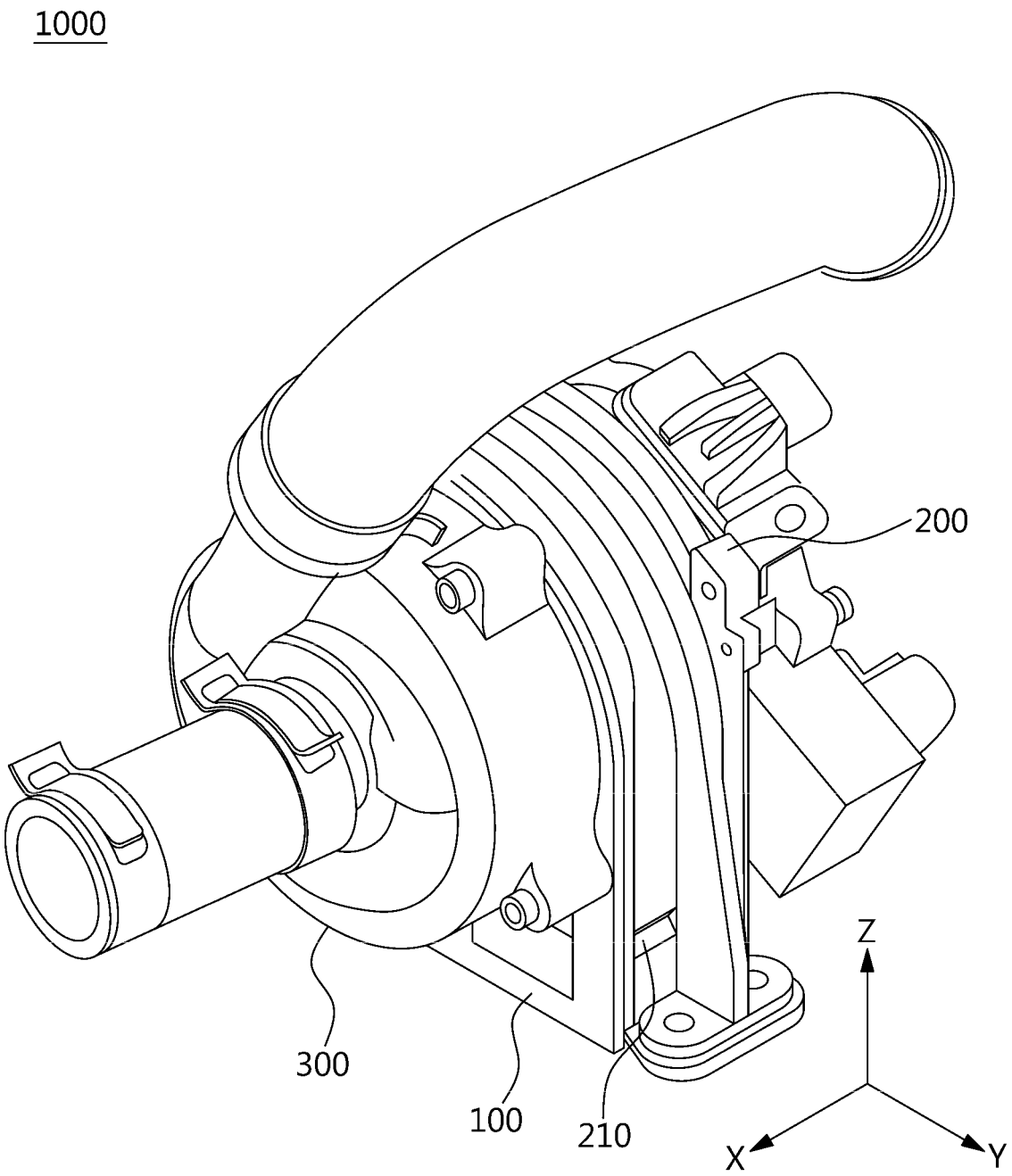
FIG. 1 is a perspective view of a mounting assembly of an electric pump according to a form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

It is to be understood that when any component is referred to as being connected to or coupled to another component, it may be connected directly to or coupled directly to another component or be connected to or coupled to another component with the other component intervening therebetween.

The "connection" used herein refers to a direction connection or an indirect connection between one member and other members, and may refer to all physical connections such as adhesion, attachment, fastening, joining, and bonding.

In addition, expressions such as 'first and second' are used only to distinguish a plurality of components, and do not limit an order or other features among components.

Singular forms are intended to include plural forms unless the context clearly indicates otherwise. It may be interpreted that terms "include", "have", or the like, specify the presence of features, numerals, steps, operations, components, parts mentioned in the present specification, or a combination thereof, but do not preclude the addition of one or more other features, numerals, steps, operations, components, parts, or a combination thereof.

Figure 2:
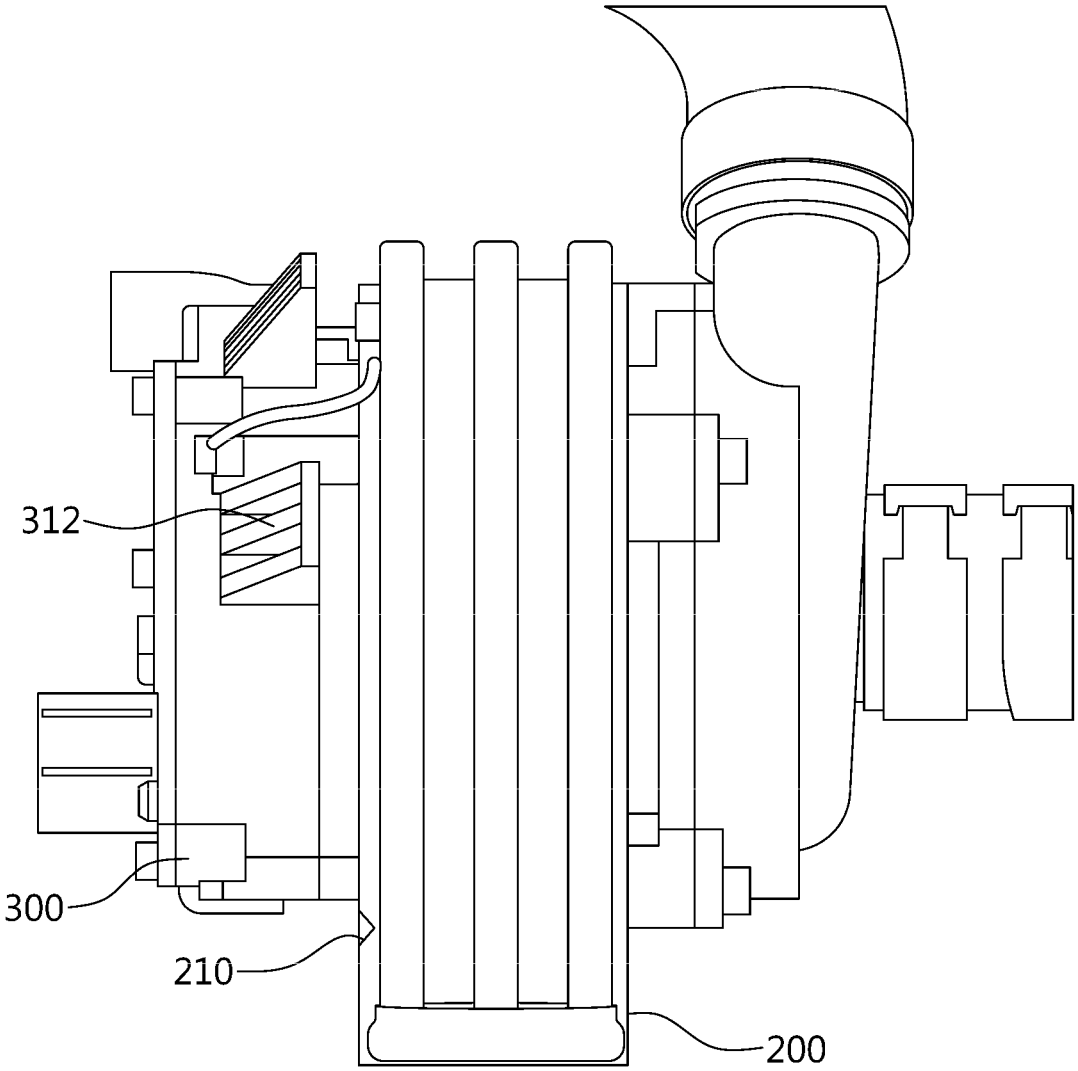
FIG. 2 is a schematic side view of the mounting assembly of the electric pump according to the form of the present disclosure.
Figure 3:
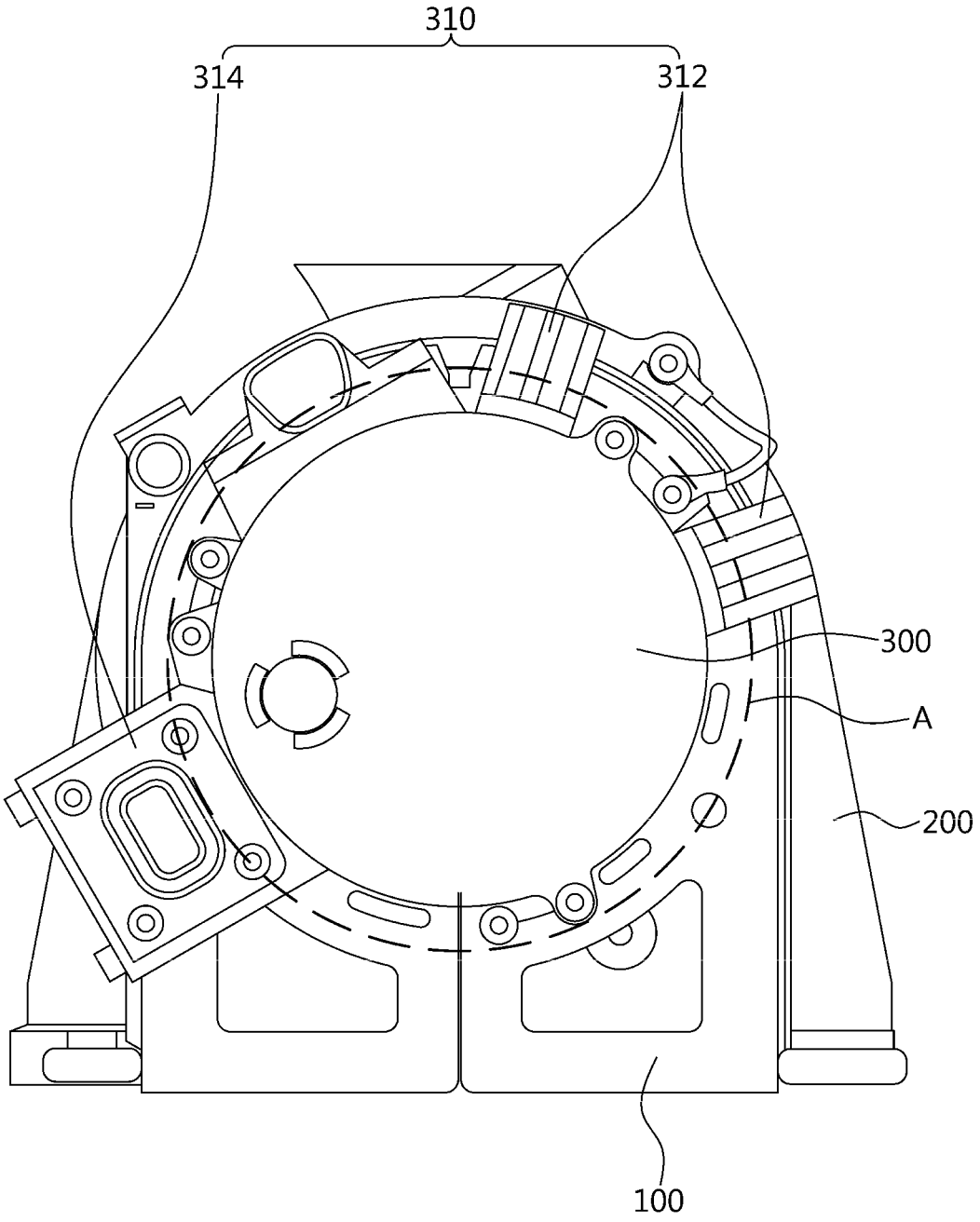
FIG. 3 is a schematic front view of the mounting assembly of the electric pump according to the form of the present disclosure.

FIG. 1 is a perspective view of a mounting assembly of an electric pump according to a form of the present disclosure, FIG. 2 is a schematic side view of the mounting assembly of the electric pump according to the form of the present disclosure, and FIG. 3 is a schematic front view of the mounting assembly of the electric pump according to the form of the present disclosure.

Referring to FIGS. 1 to 3, a mounting assembly 1000 of an electric pump 300 includes a mounting body 100 which mounts the electric pump 300 and a bracket 200 having a structure which encloses and fixes the mounting body 100, in which force dampening elements 310 of the electric pump 300 hit a seating portion 110 (FIG. 5) of the mounting body 100 from a rear along a fracture line A of the mounting body 100 to damage the seating portion 110, so the electric pump 300 moves toward a front of the vehicle.

In addition, a fracture notch 210 is formed on one side of a lower part of the bracket 200, for example, a rear side of the lower part of the bracket 200, so that the fracture notch 210 is fractured at the time of the collision, thereby easily moving the electric pump 300 toward the front of the vehicle.

As shown in FIG. 3, the force dampening elements 310 are formed on an outer peripheral part of the electric pump 300 for forming the fracture line A on the mounting body 100. The force dampening elements 310 include a fracture blade 312 and a housing connector 314.

Figure 4:
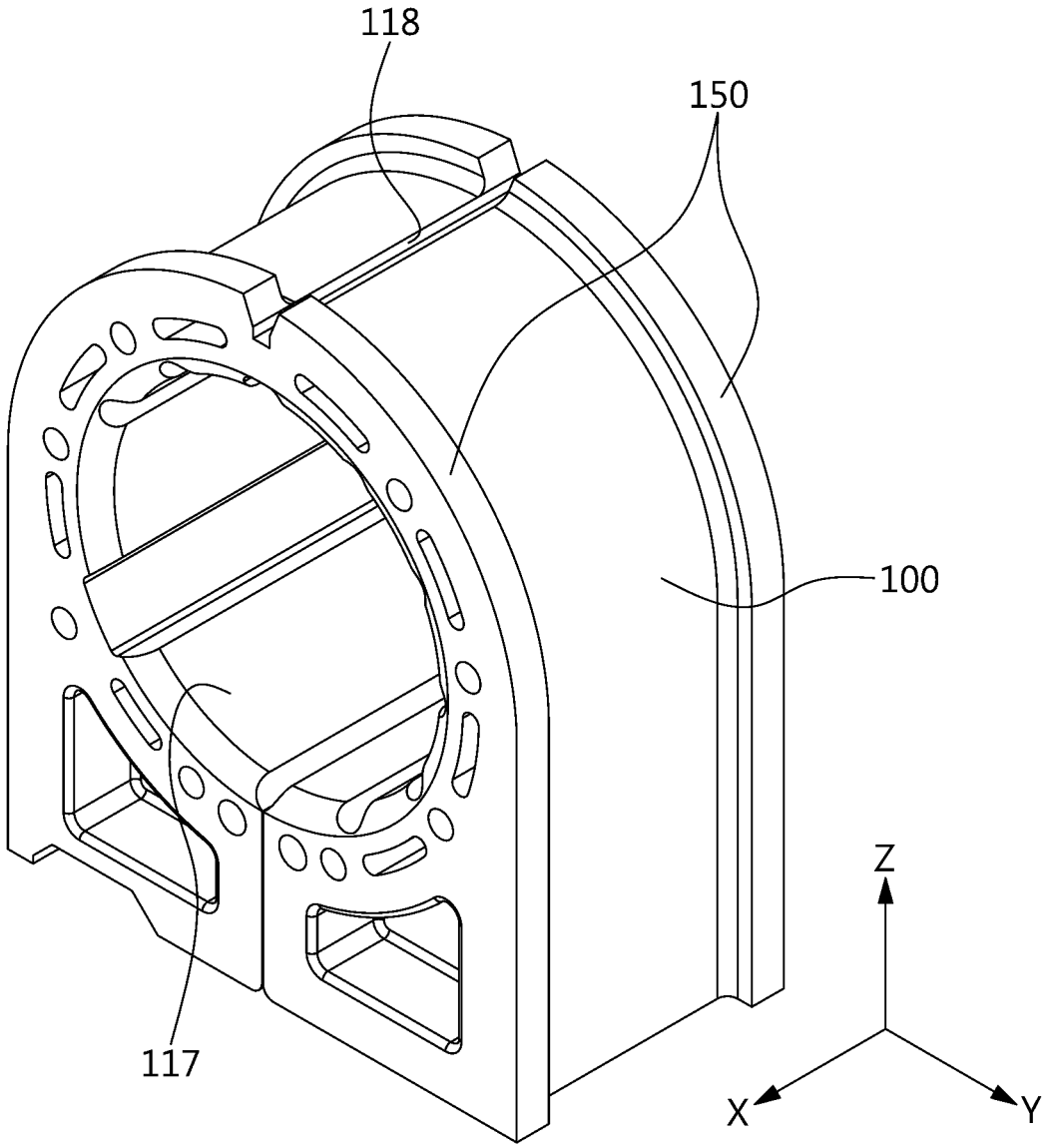
FIG. 4 is a perspective view of a mounting body of the mounting assembly of the electric pump according to the form of the present disclosure.
Figure 5:
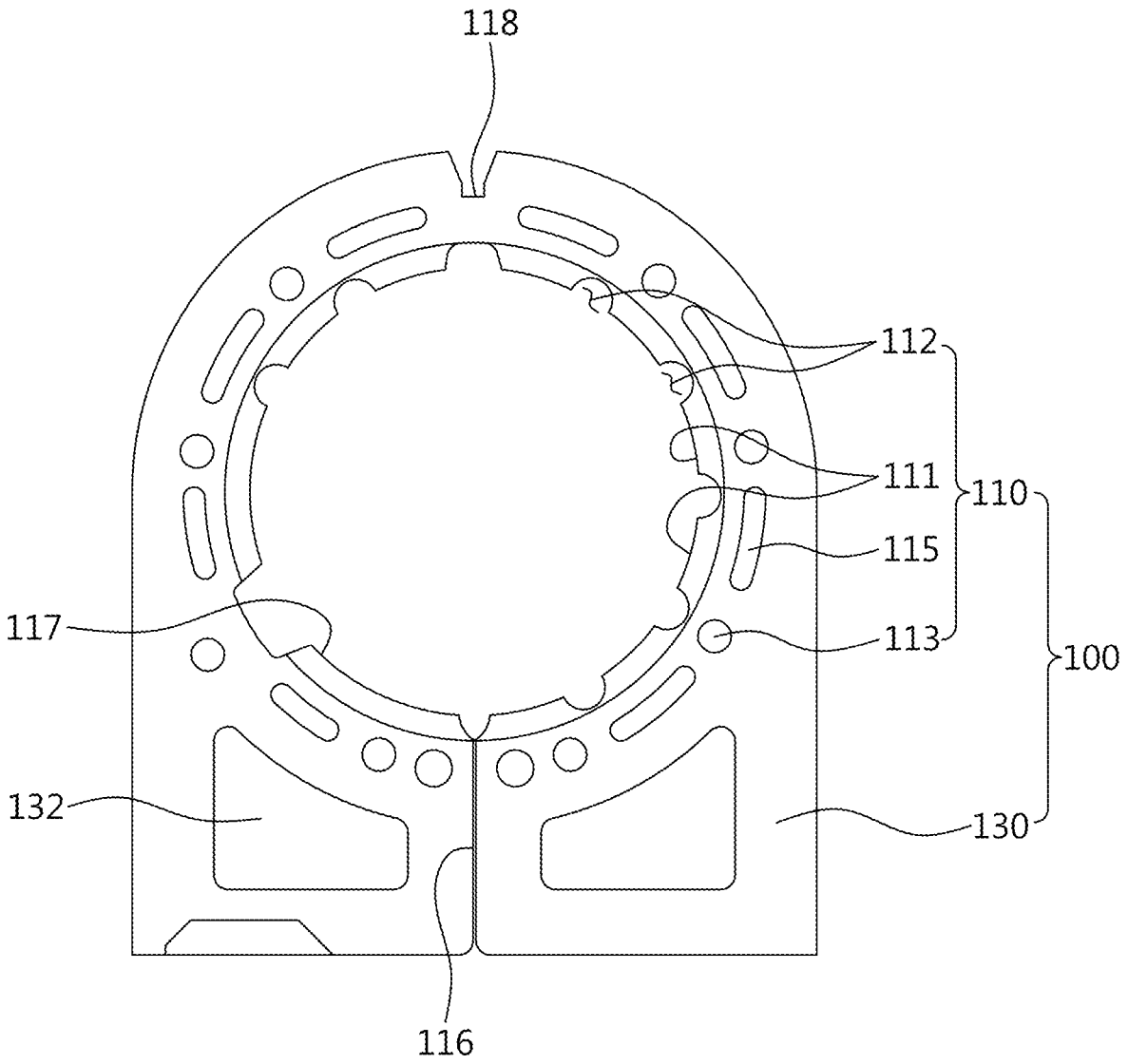
FIG. 5 is a schematic front view of the mounting body of the mounting assembly of the electric pump of FIG. 4 according to the form of the present disclosure.

FIG. 4 is a perspective view of a mounting body of the mounting assembly of the electric pump according to the form of the present disclosure and FIG. 5 is a schematic front view of the mounting body of the mounting assembly of the electric pump of FIG. 4 according to the form of the present disclosure.

Referring to FIGS. 4 and 5 together with FIG. 1, the mounting body 100 is preferably made of rubber. The mounting body 100 includes a seating portion 110 on which the electric pump 300 is seated, and a fixing portion 130 which extends downward from the seating portion 110 for fixing to a bottom surface.

As shown in FIG. 5, the seating portion 110 has an annular shape, and the seating portion 110 includes inner pressing surfaces 111, at least one inner hole 112 formed between the inner pressing surfaces 111, at least one outer hole 113 positioned on an outer periphery of the inner hole 112, and at least one high frequency damping slot 115 positioned at the same outer periphery as the outer hole 113.

The inner hole 112 preferably has a semi-circular shape, the outer hole 113 preferably has a circular shape, and the high frequency damping slot 115 preferably has an arc shape. In addition, it is preferable that the outer hole 113 and the high frequency damping slot 115 are alternately formed around the outer periphery of the inner holes 112.

For example, bracket guides 150 for guiding the bracket 200 are formed on the outer edge of the mounting body 100. In addition, the seating portion 110 is formed with a mounting open slot 116, and an inside of the seating portion 110 is provided with a stopper 117. Furthermore, an outside of the seating portion 110 is provided with an opening notch 118.

As shown in FIG. 5, the fixing portion 130 is formed in a symmetrical shape with respect to a center line of the mounting body 100 along Z-axis (see FIG. 4) and is provided with a load damper 132, and the load damper 132 is preferably formed in an indented shape. It is preferable that a thickness of the load damper 132 is determined depending on the load of the electric pump 300.

Figure 6:
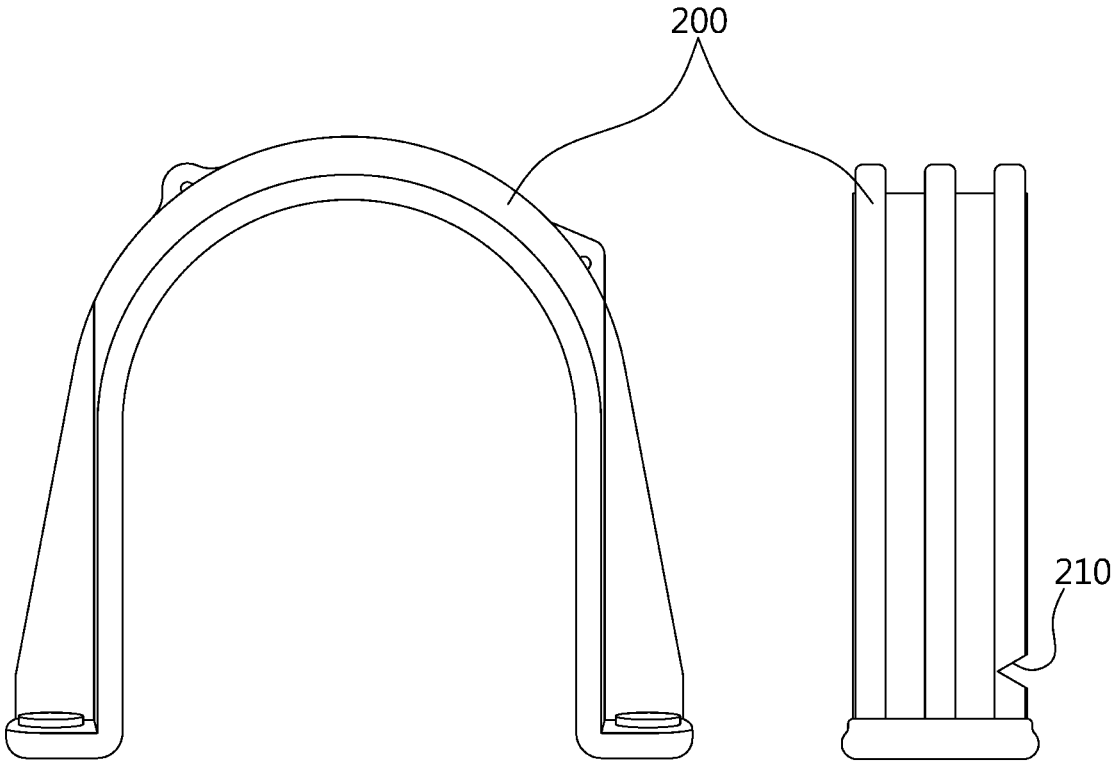
FIG. 6 is a schematic front and side view of a bracket of the mounting assembly of the electric pump according to the form of the present disclosure.

FIG. 6 is a schematic front and side view of a bracket 200 of the mounting assembly of the electric pump according to the form of the present disclosure.

Referring to FIG. 6, for example, the bracket 200 has a U-letter shape, and the fracture notch 210 is formed on the lower part of the bracket 200.

The bracket 200 is seated between the bracket guides 150 (FIG. 4) which are formed on the outer edge of the mounting body 100 (FIG. 5) to control the movement of the electric pump 300 (FIG. 4) which is generated in Y-axis and Z-axis directions.

Referring back FIGS. 1 and 4, an X-axis, a Y-axis, and a Z-axis are formed as a XYZ coordinate system. In the XYZ coordinate system, the X axis is a direction in which the mounting assembly of the electric pump is mounted to move the electric pump at the time of a collision, the Y axis is a direction vertical to a horizontal direction to the X axis, and the Z axis is a direction vertical to the X axis and the Y axis.

Figure 7:
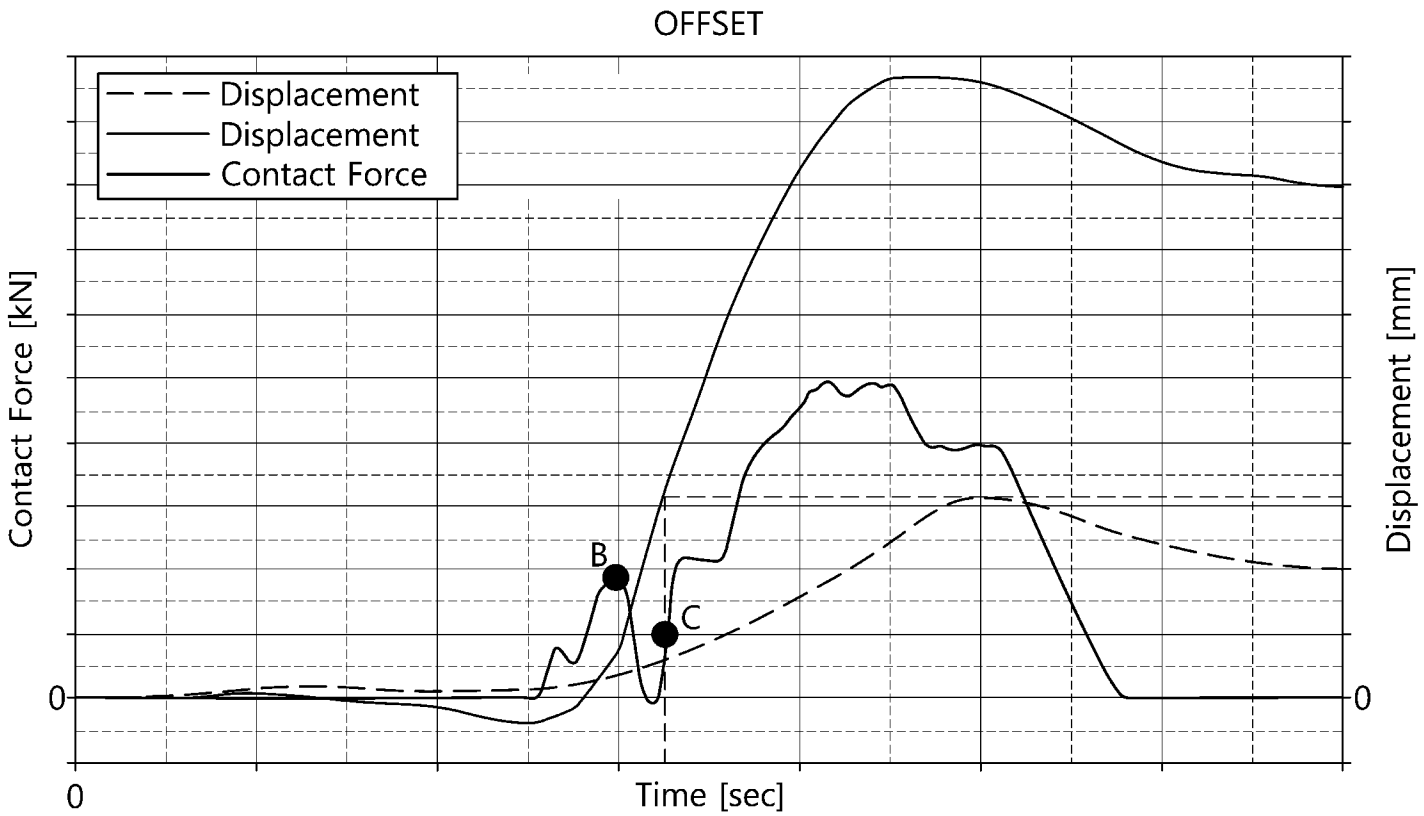
FIG. 7 is a graph illustrating a force applied at the time of a collision of the mounting assembly of the electric pump according to the form of the present disclosure.

FIG. 7 is a graph illustrating a force applied at the time of a collision of the mounting assembly of the electric pump according to the form of the present disclosure. Referring to FIG. 7, a stress is concentrated on the fracture notch 210 portion at the time of the collision, and thus a breakage occurs and the electric pump is moved in the X-axis direction. Furthermore, the electric pump 300 preferably has a bracket rigidity equal to or more than point C for maintaining a mounting fastening force and has the bracket rigidity equal to or less than point B for breaking the fracture notch 210 portion at the time of the collision.

Figure 8:
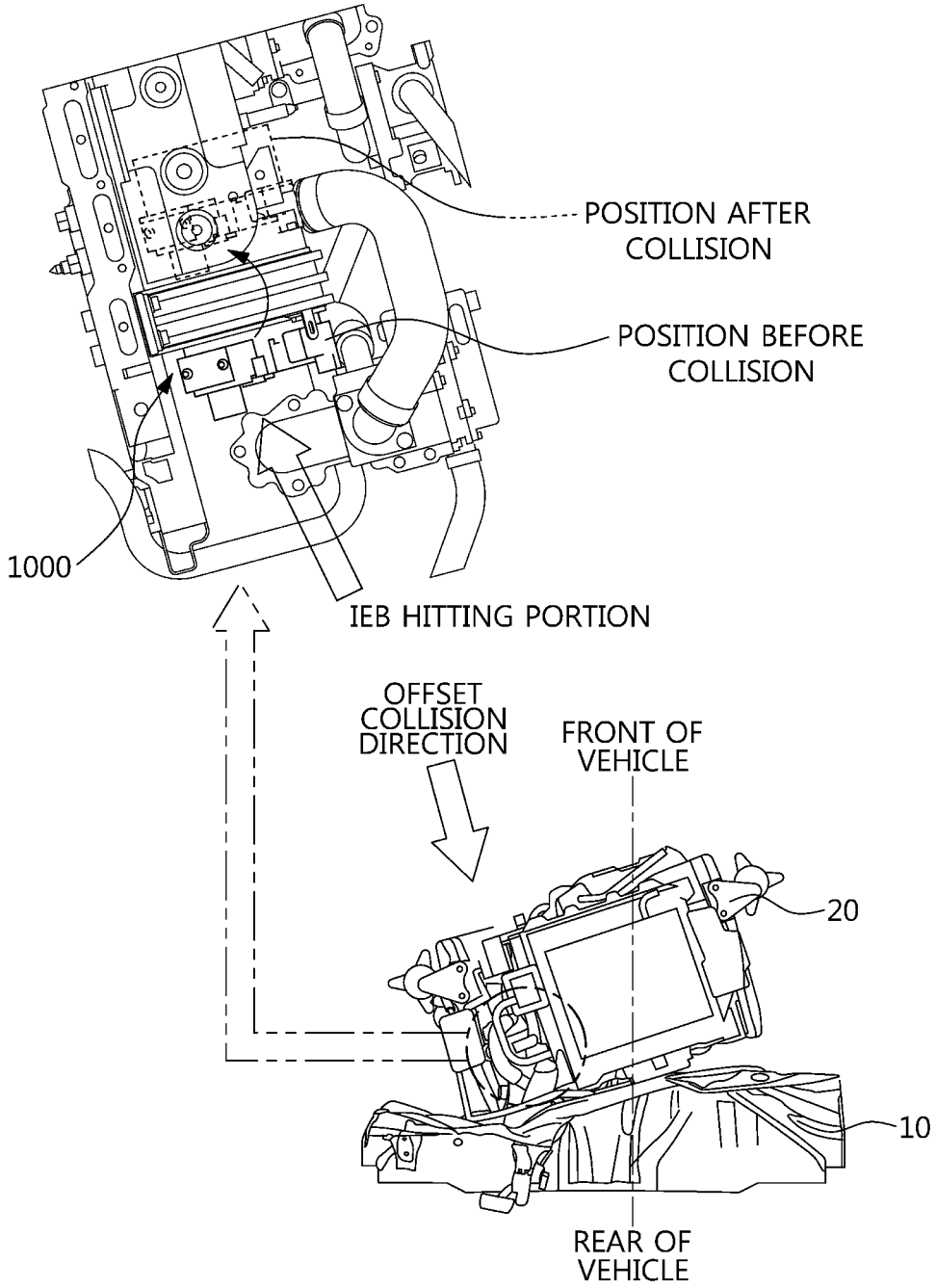
FIG. 8 is a schematic view illustrating an example of the collision of the mounting assembly of the electric pump according to the form of the present disclosure.

FIG. 8 is a schematic view illustrating an example of the collision of the mounting assembly of the electric pump according to the form of the present disclosure.

In describing an operation relationship and a manufacturing method according to a form of the present disclosure with reference to FIG. 8 with FIGS. 1 to 7, the mounting assembly 1000 of the electric pump 300 includes the mounting body 100 on which the electric pump 300 is mounted and the bracket 200 having the structure which encloses and fixes the mounting body 100. The mounting body 100 includes the seating portion 110 on which the electric pump 300 is seated and the fixing portion 130 which extends downward from the seating portion 110 for fixing to the bottom surface.

As shown in FIG. 5, the electric pump 300 is mounted on the seating portion 110 of the mounting body 100, but when the electric pump 300 is assembled with the seating portion 110, the open slot 116 and the opening notch 118 is opened and thus the seating portion 110 is opened left and right, thereby fastening the electric pump 300.

After the electric pump 300 is seated on the seating portion 110 of the mounting body 100, the bracket 200 is slidably engaged along the bracket guide 150, and the mounting assembly 1000 of the electric pump 300 is mounted in the mounting bolt holes formed at both ends of the bracket 200 by using the mounting bolt while being fastened with an upper surface of an engine room.

In the mounting assembly 1000 of the electric pump 300, as shown in FIG. 1, the bracket 200 controls the movement of the electric pump 300 in the Y-axis and Z-axis directions of the electric pump 300, and the bracket guide 150 of the mounting body 100 controls the movement of the electric pump 300 in the X-axis direction of the electric pump 300.

In addition, a width of the mounting body 100 is substantially same as that of the housing of the electric pump 300 along the X-axis. The mounting body 100 is fixed by using a hydraulic unit of the electric pump 300 and a stopper formed on the control unit to control the movement of the electric pump 300 in the X-axis direction.

The mounting assembly 1000 of the electric pump 300 damps the low frequency vibration by the inner hole 112 for maintaining noise, vibration and harshness (NVH) performance and damps the high frequency vibration in the outer hole 113 and the high frequency damping slot 115 positioned at the same radius (outer periphery) as the outer hole 113.

In addition, in the mounting assembly 1000 of the electric pump 300, the load damper 132 which can support the pump load and control the vibration is formed below the electric pump, and the thickness of the load damper 132 along the X-axis, is set in proportion to the load of the pump and the cooling water.

The stopper 117 is formed to inhibit the rotation of the electric pump 300. The corresponding shape of the stopper 117 is also formed in the housing of the electric pump 300 to engage the stopper 117 and the housing with each other, such that the electric pump 300 is fixed by inhibiting the rotation about the X-axis.

As shown in FIG. 8, in an assembled state of the mounting assembly 1000, when the collision of the vehicle occurs, the engine room 20, in which the electric pump 300 is mounted, moves toward the interior space of the vehicle. At this time, the electric pump 300 is mounted on the dashboard 10 of the vehicle to collide with an intelligent emergency brake (IEB) 12. That is, if the engine room 20 moves from the front of the vehicle toward the driver's seat when the offset collision occurs, the IEB 12 mounted on the front of the dashboard 10 hits the electric pump 300 from behind toward the front of the vehicle.

Referring back to FIGS. 3 and 5, If the IEB 12 hits the rear of the electric pump 300, the force dampening elements 310 of the electric pump 300 spaced apart from the mounting body 100 hits the fracture line A formed by the outer hole 113 and the high frequency damping slot 115 of the mounting body 100, thereby causing the fracture.

When the fracture occurs along the fracture line A of the mounting body 100 due to the rear impact of the IEB 12, and the mounting open slot 116 and the opening notch 118 are opened to loose the fixing of the electric pump 300, and is bent toward the front of the vehicle due to the fracture notch 210 formed at the lower part of the bracket 200 for moving the electric pump 300 toward the front of the vehicle.

Accordingly, the mounting assembly 1000 of the electric pump 300 according to the present disclosure can inhibit the devices mounted on the vehicle from intruding into the interior space of the vehicle at the time of the collision of the vehicle to reduce the injury of the drivers, thereby improving the safety.

While this present application has been described in connection with what is presently considered to be practical exemplary forms, it is to be understood that the present disclosure is not limited to the disclosed forms, but, on the contrary, it is intended to cover various modification and equivalent arrangements included within the spirit and scope of the present disclosure.

What is claimed is:

1. A mounting assembly of an electric pump for a vehicle, the mounting assembly comprising:

a mounting body configured to mount the electric pump; and a bracket including a structure configured for enclosing and fixing the mounting body, wherein force dampening elements of the electric pump are configured to hit a seating portion of the mounting body along a fracture line of the mounting body to break the seating portion and move the electric pump toward a front of the vehicle, and wherein a lower part of the bracket is provided with a fracture notch to be fractured at a time of a collision.

2. The mounting assembly of claim 1, wherein a material of the mounting body is rubber.

3. The mounting assembly of claim 1, wherein the mounting body further includes:

the seating portion on which the electric pump is seated, and a fixing portion extended downward from the seating portion for fixing to a bottom surface.

4. The mounting assembly of claim 1, wherein the seating portion is formed in an annular shape.

5. The mounting assembly of claim 1, wherein the seating portion includes:

inner pressing surfaces, at least one inner hole formed between the inner pressing surfaces, at least one outer hole positioned at an outer periphery of the inner hole, and a high frequency damping slot positioned at the same outer periphery as the outer hole.

6. The mounting assembly of claim 5, wherein the inner hole is formed in a semi-circular shape, the outer hole is formed in a circular shape, and the high frequency damping slot is formed in an arch shape.

7. The mounting assembly of claim 5, wherein the outer hole and the high frequency damping slot are alternately formed along the outer periphery of the inner hole.

8. The mounting assembly of claim 5, wherein the outer hole and the high frequency damping slot form the fracture line on the seating portion of the mounting body.

9. The mounting assembly of claim 1, wherein the seating portion is formed with a mounting open slot.

10. The mounting assembly of claim 1, wherein an inside of the seating portion is provided with a stopper.

11. The mounting assembly of claim 1, wherein an outside of the seating portion is provided with an opening notch.

12. The mounting assembly of claim 3, wherein the fixing portion is formed in a symmetrical shape with respect to a center line of the mounting body along a Z-axis.

13. The mounting assembly of claim 3, wherein the fixing portion is provided with a load damper.

14. The mounting assembly of claim 13, wherein the loading damper is formed in an indented shape.

15. The mounting assembly of claim 1, wherein an outer edge of the mounting body is provided with a bracket guide for guiding the bracket.

16. The mounting assembly of claim 1, wherein the bracket is formed in a U-letter shape.

17. The mounting assembly of claim 1, wherein an outer peripheral part of the electric pump is provided with the force dampening elements to form the fracture line on the seating portion of the mounting body.

18. The mounting assembly of claim 17, wherein the force dampening elements include a fracture blade and a housing connector.

19. A mounting assembly of an electric pump for a vehicle, the mounting assembly comprising:

a mounting body including the electric pump mounted thereon at a time of an offset collision, the mounting body allowing force dampening elements of the electric pump to hit a seating portion of the mounting body along a fracture line of the mounting body to break the seating portion and move the electric pump toward a front of the vehicle; and a bracket including a structure configured for enclosing and fixing the mounting body, wherein a lower part of the bracket is provided with a fracture notch to be fractured at a time of a collision.

* * * * *